US008746141B2

(12) United States Patent
Ruiz Suesa et al.

(10) Patent No.: US 8,746,141 B2
(45) Date of Patent: Jun. 10, 2014

(54) PRINTING MACHINE AND PRINTING GROUP FOR VARIABLE FORMAT OFFSET

(75) Inventors: Luis Antonio Ruiz Suesa, Girona (ES); Jordi Puig Vila, Girona (ES)

(73) Assignee: Neopak, SL, Riudellots de la Selva (Girona) (ES)

( * ) Notice: Subject to any disclaimer, the term of this patent is extended or adjusted under 35 U.S.C. 154(b) by 675 days.

(21) Appl. No.: 13/266,343

(22) PCT Filed: Sep. 16, 2009

(86) PCT No.: PCT/ES2009/000455

§ 371 (c)(1),
(2), (4) Date: Oct. 26, 2011

(87) PCT Pub. No.: WO2010/034855

PCT Pub. Date: Apr. 1, 2010

(65) Prior Publication Data

US 2012/0055357 A1 Mar. 8, 2012

(30) Foreign Application Priority Data

Sep. 29, 2008 (ES) ..... 200802752

(51) Int. Cl.
*B41F 7/02* (2006.01)
*B41F 13/24* (2006.01)

(52) U.S. Cl.
USPC ..... 101/218; 101/219; 101/248

(58) Field of Classification Search
CPC ..... B41F 13/20; B41F 13/30; B41F 13/34; B41F 13/38; B41F 13/44; B41F 5/24; B41F 31/30; B41F 31/301; B41F 31/302
USPC ..... 101/182, 184, 185, 216, 218, 219, 221, 101/247, 351.1, 351.2, 351.3, 351.4, 101/352.01, 352.02, 352.03, 352.04, 352.05
See application file for complete search history.

(56) References Cited

U.S. PATENT DOCUMENTS 4,413,560 A * 11/1983 Rogge ..... 101/247
4,852,515 A * 8/1989 Terasaka et al. ..... 118/663

(Continued)

FOREIGN PATENT DOCUMENTS

DE 102006061053 A1 7/2008
EP 0027321 4/1981

(Continued)

OTHER PUBLICATIONS

International Search Report for International Appln. No. PCT/ES2009/000455 mailed Jan. 21, 2010.

*Primary Examiner* — Ren Yan
(74) *Attorney, Agent, or Firm* — RatnerPrestia

(57) ABSTRACT

The printing machine for variable format offset includes a printing roller or drum, and at least one printing group including a guide system fixed in relation with the printing roller or drum, a first carriage displaceable along the guide system and configured for supporting a rubber-wrapped blanket roller or sleeve of variable size, a second carriage displaceable along the guide system and configured for supporting a plate roller or sleeve of variable size, and a third carriage displaceable along the guide system carrying an offset inking head. The head has devices for approximating the third carriage to the plate roller, identifying and fixing its working position in relation with the plate sleeve and fitting ink-supplying roller or rollers to the plate roller.

21 Claims, 11 Drawing Sheets

(56) References Cited

U.S. PATENT DOCUMENTS

| | | | | |
|---|---|---|---|---|
| 5,370,047 | A * | 12/1994 | Compton | 101/216 |
| 6,176,181 | B1 * | 1/2001 | Van Ryzin et al. | 101/216 |
| 6,494,138 | B1 | 12/2002 | Gottling | |
| 7,258,066 | B2 * | 8/2007 | Koopmann | 101/247 |
| 7,735,418 | B2 * | 6/2010 | Hoffmann et al. | 101/180 |
| 7,963,222 | B2 * | 6/2011 | Esparch Marti et al. | 101/351.1 |
| 2001/0035104 | A1 | 11/2001 | Gottling | |

FOREIGN PATENT DOCUMENTS

| | | | |
|---|---|---|---|
| EP | 0476516 | A1 | 3/1992 |
| EP | 0656259 | A1 | 6/1995 |
| EP | 1101611 | A1 | 5/2001 |
| EP | 1932667 | A1 | 6/2008 |
| ES | 2216725 | A1 | 10/2004 |

* cited by examiner

PRINTING MACHINE AND PRINTING GROUP FOR VARIABLE FORMAT OFFSET

This application is a U.S. National Phase Application of PCT International Application No. PCT/ES2009/000455, filed Sep. 16, 2009.

TECHNICAL FIELD

The present invention relates to a printing machine and a printing group for wet, dry or waterless variable format offset with a printing roller or drum in a fixed position, comprising at least one offset printing group arranged for printing on a substrate in the form of continuous band. Said offset printing group is prepared to be readily converted into a flexographic printing group. Thus, according to the present invention a printing machine can be formed from several of such printing groups for printing on a substrate in the form of continuous band either by means of wet, dry or waterless offset or by flexography, or a combination of offset and flexography, and with a variety of formats.

BACKGROUND OF THE INVENTION

The patent application EP-A-0027321 describes a printing machine for variable format offset wherein have been provided two structures articulated rotationally about a shaft supporting the plate and printer rollers and a fixed structure on which the rubber-wrapped blanket is exchanged.

The European patent EP-A-1101611 relates to a device for supporting and exchanging in variable position with respect to the fixed position ink head, at least one of the plate, rubber-wrapped blanket and printer rollers in an offset printing press wherein the variable position elements are provided with arms which are rotatable about respective shafts, comprising the positioning means for positioning actuating means to rotate said support arms.

The European patent application EP-A-1 932 667 describes a printing machine for variable format offset wherein the offset inking head and the plate roller are integrated in a unit which is linearly or rotationally displaced together, separating it from the rubber-wrapped blanket roller, to allow changing said plate and rubber-wrapped blanket rollers and, if necessary, changing format.

The present application offers an alternative solution for changing format, based on printing groups configured as modular units provided to be operatively associated to a fixed position printing roller or drum, wherein the rubber-wrapped blanket roller, the plate roller and the offset inking head of each printing group are installed on respective support carriages displaced linearly.

DISCLOSURE OF THE INVENTION

According to a first aspect, the present invention provides a printing machine for variable format offset with fixed position printing roller or drum, which incorporates in combination at least one printing roller or central printing drum in a fixed position, and at least one printing group comprising a fixed linear guide system fixed in a support structure in relation with said printing roller or central printing drum, and three carriages arranged to be displaced along said linear guide system. The first of said carriages is provided with supports to hold a first shaft configured for receiving a rubber-wrapped blanket roller or sleeve selected from a set of rubber-wrapped blanket rollers or sleeves of different sizes. The second of the carriages is provided with supports to hold a second shaft configured for receiving a plate roller or sleeve selected from a set of plate rollers or sleeves of different sizes. On the third of the carriages an offset inking head is installed, which is provided with a plurality of ink-supplying rollers and with devices for approximating said third carriage to said plate roller or sleeve installed in said second shaft, identifying and fixing the working position thereof in relation with the plate roller or sleeve and fitting all the mentioned ink-supplying rollers to the perimeter of the plate roller or sleeve.

This construction allows selectively installing rubber-wrapped blanket rollers or sleeves and plate rollers or sleeves of different sizes for different printing formats ranging between a minimum format and a maximum format. Preferably, the three carriages are arranged to run in a horizontal direction on common guide elements, and the first and second carriages are moved by respective nut and screw systems actuated by independent motors. The third carriage is moved by one or more linear actuators. The horizontal arrangement of the guide elements is preferred because with it, the requirements of the actuation devices are minimized, taking into account the high weight of the offset inking unit, which allows, for example, using pneumatic actuating actuators for displacing the third carriage.

The plurality of ink-supplying rollers of the offset inking head comprise between them a central ink-supplying roller assembled in a central pivoting support connected to a central linear actuator arranged to push said central pivoting support until contacting and pressing said central ink-supplying roller against the plate roller or sleeve. The ink-supplying rollers further comprise upper and lower ink-supplying rollers assembled in respective pivoting supports connected to linear actuators arranged to push the upper and lower pivoting supports until pressing said upper and lower ink-supplying rollers against the plate roller or sleeve.

The mentioned first and second shafts supported respectively in the first and second carriages are further configured for receiving, respectively, a plate cylinder roller or sleeve and a screen roller or sleeve suitable for flexographic printing substituting the respective rubber-wrapped blanket roller or sleeve and plate roller or sleeve suitable for offset printing. Furthermore, the displacement device of the third carriage is configured to separate the offset inking head from the second shaft a sufficient distance to allow installing a flexographic inking unit operatively associated to a screen roller or sleeve installed in the second shaft, whereby the offset printing group is converted into a flexographic printing group. Obviously, the first shaft accepts plate cylinder rollers or sleeves of different sizes from a minimum format to a maximum format. Although the second shaft is also prepared for accepting screen rollers or sleeves of different sizes, installing screen rollers or sleeves of a constant size is preferred since in the flexographic system the diameter of the screen roller or sleeve does not influence the format, which is exclusively defined by the plate cylinder roller or sleeve. The installation of screen rollers or sleeves of a constant diameter makes providing guide, support and fixation elements easier for installing the flexographic printing group in the second carriage in a position adjacent to the second shaft.

Although the printing machine could include a single printing group of the type described, the technical principles on which the present invention is based allow constructing printing machines provided with multiple printing groups, which can have an individual printing roller for each one, they can be arranged by pairs to work on a common printing roller for each pair or they can be arranged around a single central printing drum common for all of them. Preferably, the printing machine is configured for printing on a substrate in the form of continuous band supported dynamically on the printing rollers or central printing drum. A single central printing drum common for all the printing groups is the most favorable configuration when the substrate in the form of continuous band is prone to deformations by stretching.

According to a second aspect, the present invention provides a printing group for variable format offset with fixed position printing roller or drum adopting the shape of a printer module with the characteristics of the printing group described above. The printing group of the present invention comprises a support structure including two facing walls arranged in opposite ends of the first and second shafts and perpendicular to the same. The two walls have openings through which the first and second shafts pass or can be accessed. The linear guide system comprises guide elements fixed in both walls above and below said openings, preferably equidistant from the first and second shafts. The nut and screw system also comprises screws arranged above and below the openings, preferably equidistant from the first and second shafts.

Several modules or printing groups of the present invention can be grouped to form a printing machine provided with multiple printing groups, and the support structure of each module or printing group is configured to be incorporated into or form part of a structural support assembly of the printing machine. If each printing group has its own printing roller, the latter can be installed in the support structure of the module. If contrarily there are one or more common printing rollers for pairs of printing groups or a common central printing drum for multiple printing groups, the support structures of the modules will not include a printing roller or drum but the latter will be supported in other elements of the structural assembly of the machine.

BRIEF DESCRIPTION OF THE DRAWINGS

The foregoing and other features will be better understood from the following detailed description of exemplary embodiments with reference to the attached drawings, in which.

DETAILED DESCRIPTION OF EXEMPLARY EMBODIMENTS

Figure 1:
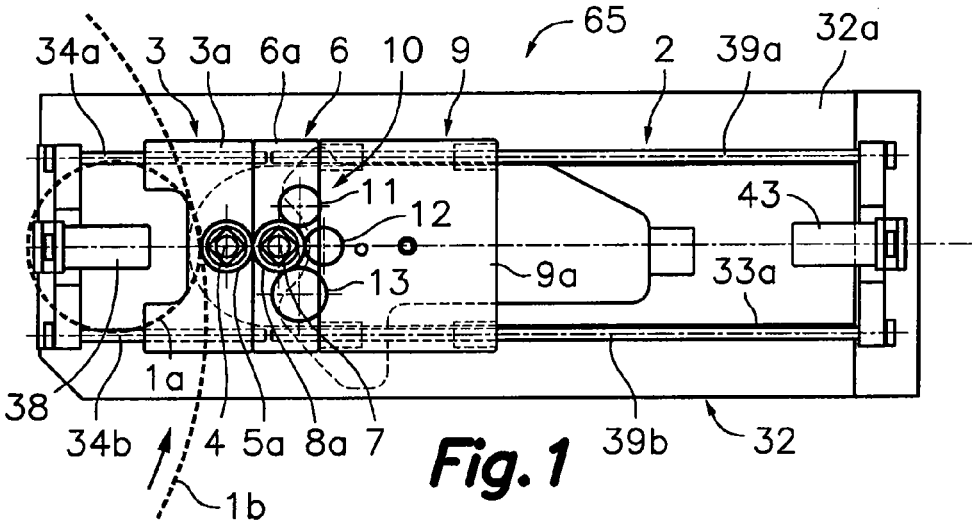
FIG. 1 is a schematic side view of a printing group for variable format offset with fixed position printing roller or drum according to an embodiment of the present invention in a working position on a minimum format.

First referring to FIGS. 1 to 6, a printing group 65 for variable format offset with fixed position printing roller or drum according to the present invention is shown therein. The present invention also contemplates a printing machine incorporating several printing groups 65 such as that of FIGS. 1 to 6 or a printing machine based on the technical principles thereof.

The printing group 65 is conceived as a module and comprises a support structure 32 on which there is fixed a linear guide system 2 positioned in relation with the position of a printing roller 1*a* installed in the same support structure 32 or a central printing drum 1*b* installed in a structural assembly 60 which the support structure 32 forms part thereof, as will be explained below in relation with FIGS. 14 to 19. The printing group 65 includes a first carriage 3, a second carriage 6 and a third carriage 9 arranged such that they can be displaced along said linear guide system 2 by actuating means which will be described below. The first carriage 3 is provided with supports rotationally holding a first shaft 4 configured for receiving in an exchangeable manner a rubber-wrapped blanket sleeve 5*a* selected from a set of rubber-wrapped blanket sleeves of different sizes. The second carriage 6 is provided with supports to rotationally hold a second shaft 7 configured for receiving in an exchangeable manner a plate sleeve 8*a* selected from a set of plate sleeves of different sizes. Alternatively, the supports of the first and second carriages 3, 6 can be configured for supporting in a rotatable and exchangeable manner respective rubber-wrapped blanket roller 5*a* and plate roller 8*a* integrally provided with their corresponding shafts 4, 7.

Figure 2:
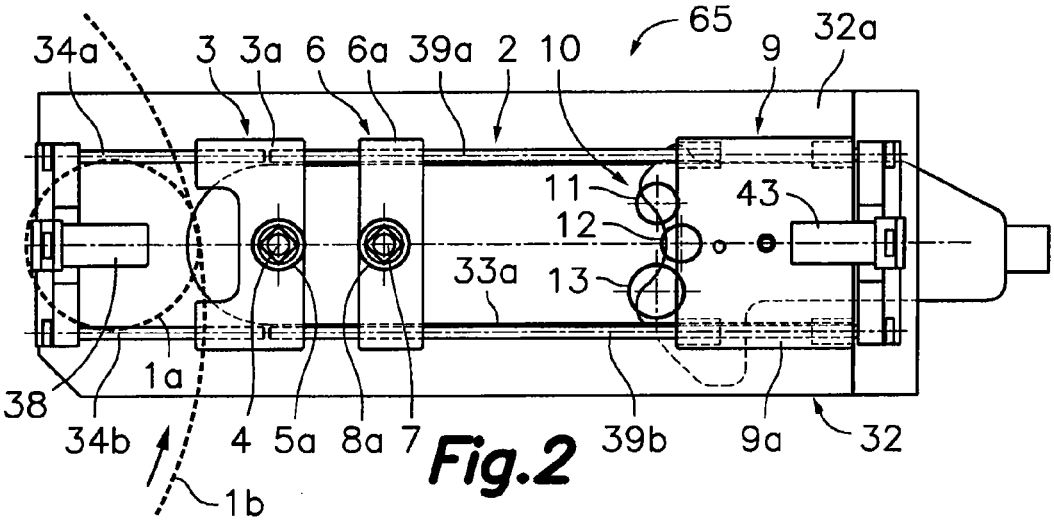
FIG. 2 is a schematic side view of the printing group of FIG. 1 in a resting position with minimum format.
Figure 3:
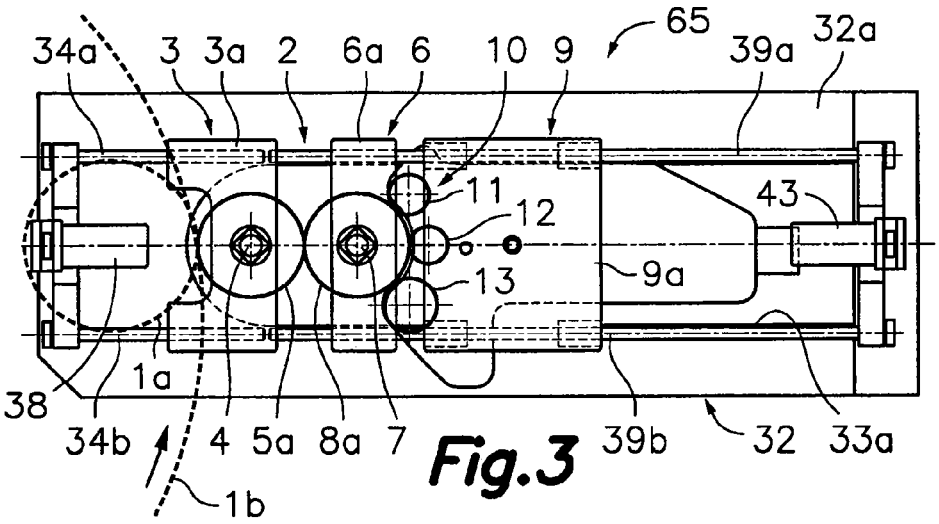
FIG. 3 is a schematic side view of the printing group of FIG. 1 in a working position on a maximum format.
Figure 4:
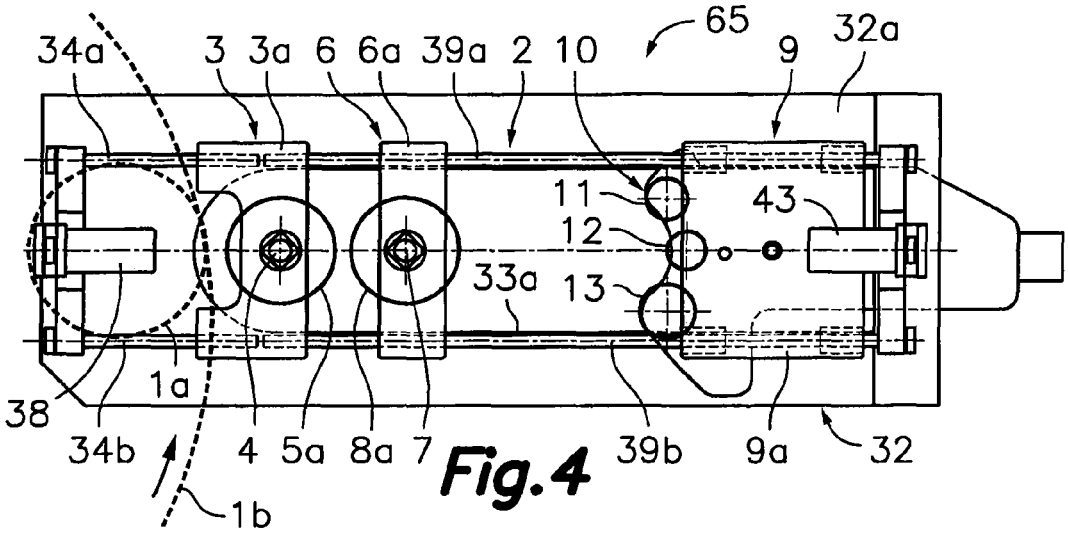
FIG. 4 is a schematic side view of the printing group of FIG. 1 in a resting position with maximum format.

The rubber-wrapped blanket sleeve 5*a* and plate sleeve 8*a* are specific for the offset printing system and the rubber-wrapped blanket sleeve 5*a* and the plate sleeve 8*a* must be of the same diameter for any particular format. FIGS. 1 and 2 show the smallest acceptable rubber-wrapped blanket sleeve 5*a* and plate sleeve 8*a*, whereas FIGS. 3 and 4 show the largest acceptable rubber-wrapped blanket sleeve 5*a* and plate sleeve 8*a*. The rotation axes of the printing roller is or central printing drum 1*b*, the rubber-wrapped blanket sleeve 5*a* and the plate sleeve 8*a* are parallel to one another. In a working position (FIGS. 1 and 3), the rubber-wrapped blanket sleeve 5*a* is in contact with the printing roller 1*a* or central printing drum 1*b* and the plate sleeve 8*a* is in contact with the rubber-wrapped blanket sleeve 5*a*. In a resting position (FIGS. 2 and 4) the rubber-wrapped blanket sleeve 5*a* is separated from the printing roller 1*a* or central printing drum 1*b* and the plate sleeve 8*a* is separated from the rubber-wrapped blanket sleeve 5*a*.

An offset inking head 10 provided with a plurality of ink-supplying rollers 11, 12, 13 parallel to the rotation axis of the plate sleeve 8*a* and which, in the working position (FIGS. 1 and 3), are in contact with the same is installed on the third carriage 9. The offset inking head 10 comprises devices for approximating said third carriage 9 to the plate roller or sleeve 8*a* installed in the second shaft 7, identifying and fixing the working position thereof in relation with the position of the plate sleeve 8*a* and fitting the positions of all the mentioned ink-supplying rollers 11, 12, 13 conforming to the perimeter of the plate sleeve 8*a*, regardless of the diameter of the latter.

Figure 5:
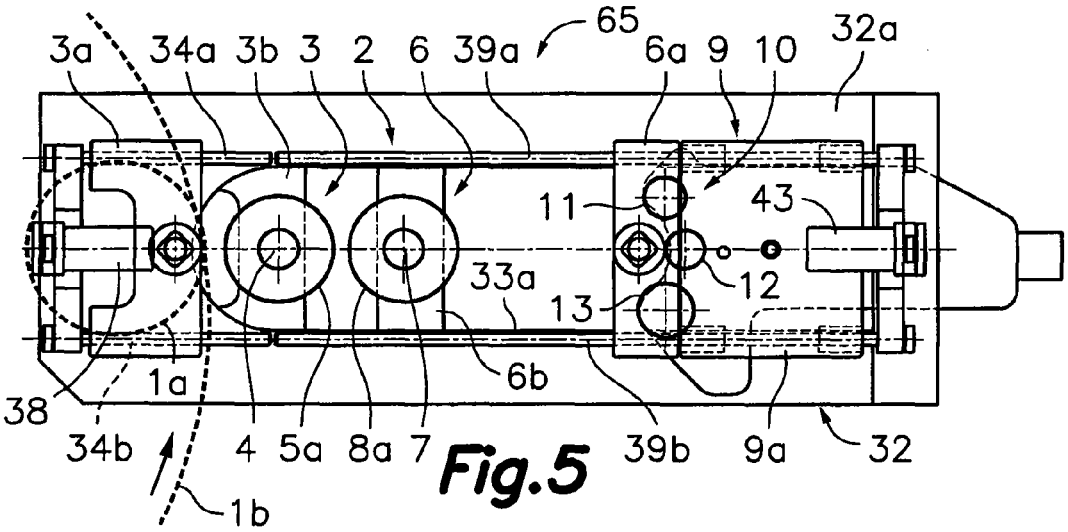
FIG. 5 is a schematic side view of the printing group of FIG. 1 in a resting position and with the operator side supports of the first and second carriages decoupled and displaced to allow a format change.
Figure 7:
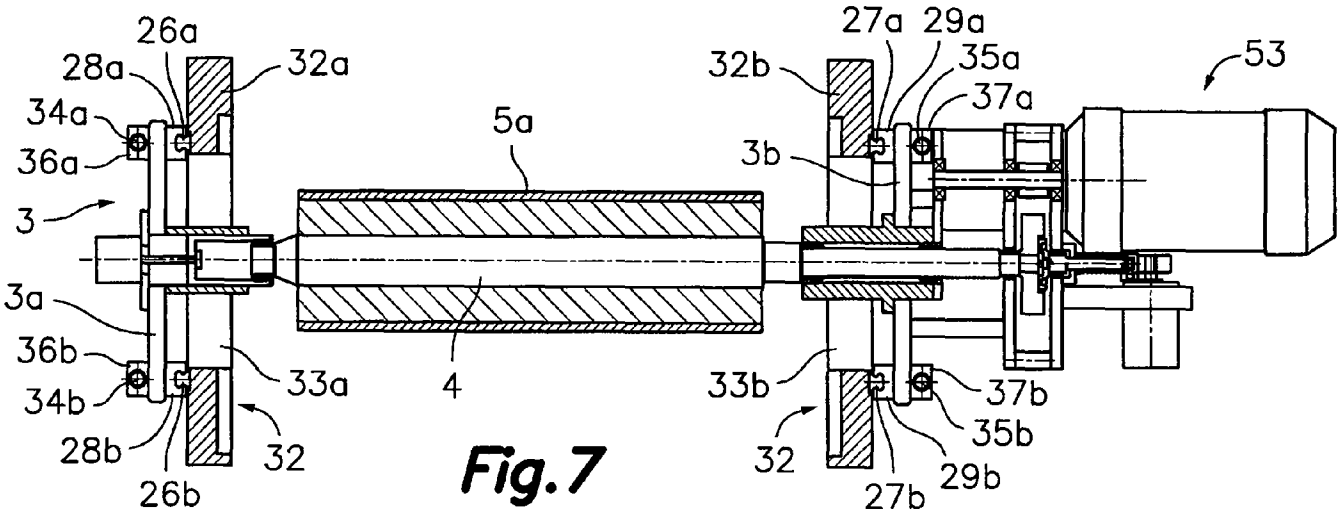
FIG. 7 is a transverse cross-section view of a first carriage of the printing group of FIG. 1.
Figure 8:
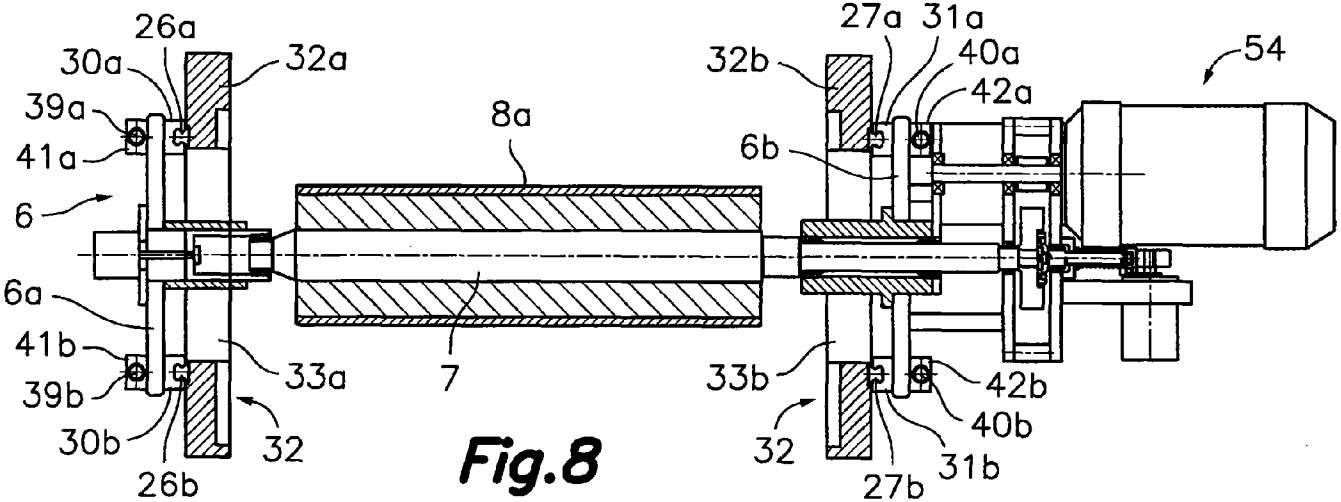
FIG. 8 is a transverse cross-section view of a second carriage of the printing group of FIG. 1.

As shown in FIGS. 7 and 8, the first carriage 3 has, at the side of the support structure 32 opposite the operator, a transmission side support 3*b* capable of supporting the first shaft 4 in cantilever and at the side of the support structure 32 wherein the operator is, an operator side support 3*a* which can be decoupled and displaced with respect to the transmission side support 3*b* to enable extracting the rubber-wrapped blanket sleeve 5*a* from the first shaft 4 and replacing it with another of the same or different size (FIG. 5). Similarly, the second carriage 6 has a transmission side support 6*b* at the side opposite the operator capable of supporting the second shaft 7 in cantilever and an operator side support 6*a* at the side of the operator which can be decoupled and displaced with respect to the transmission side support 6*b* to enable extracting the plate sleeve 8*a* from the second shaft 7 and replacing it with another of the same or different size (FIG. 5). In the operator side supports 3*a*, 6*a* of the first and second carriages 3, 6 respective actuation and transmission devices 53, 54 for rotating the first and second shafts 4, 7 are installed.

Figure 6:
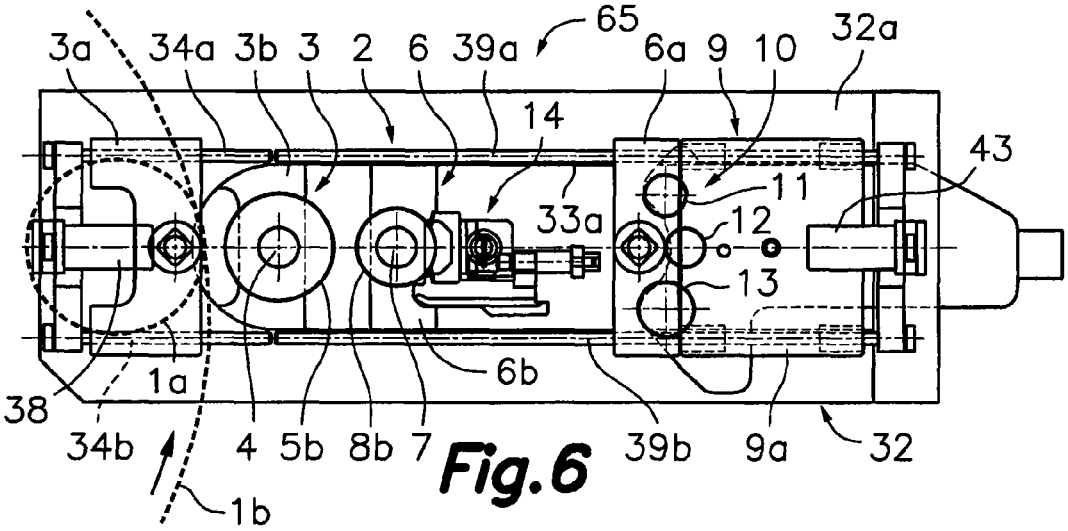
FIG. 6 is a schematic side view of the printing group of FIG. 1 in a resting position with the operator side supports of the first and second carriages decoupled and displaced, wherein the rollers or sleeves for offset printing have been replaced by flexographic printing rollers or sleeves and wherein a flexographic inking unit has been additionally installed.

An additional feature of the printing group of the present invention is that the first shaft 4 is configured for receiving a plate cylinder sleeve 5*b* substituting the rubber-wrapped blanket sleeve 5*a* and the second shaft 7 is configured for receiving a screen sleeve 8*b* substituting the plate sleeve 8*a*. Furthermore, said offset inking head 10 is provided with devices actuated to separate the third carriage 9 from the second carriage 6 a sufficient distance to allow installing a flexographic inking unit 14 operatively associated to the screen sleeve 8*b* installed in the second shaft 7 (FIG. 6). The plate cylinder rollers or sleeves 5*b* and screen rollers or sleeves 8*b* are specific for the flexographic printing system and for obtaining different formats it is only necessary to install plate cylinder sleeves 5*b* of different sizes, whereas the screen sleeves 8*b* can be of a constant diameter for any format, which simplifies the devices allowing the installation and extraction of the flexographic inking unit 14, which is fixed to the transmission side support 6*b* of the second carriage 6 and moves with the same. The flexographic inking unit 14 can be of a conventional type equipped with ink chamber and doctor blades or with one or more rubber-coated rollers. Furthermore, in the case of using a flexographic inking unit 14 with ink chamber and doctor blades, the latter could be located in the lower part of the screen roller 8*b*, such as described in patent ES-A-2216725.

In relation with FIGS. 1 to 8, guiding and actuating devices of the first and second carriages 3, 6 are described below. As shown in FIGS. 7 and 8, the support structure 32 comprises first and second facing walls 32*a*, 32*b* perpendicular to the first and second shafts 4, 7 and arranged in opposite ends of the same such that the rubber-wrapped blanket roller or sleeve 5*a* and plate roller or sleeve 8*a* are located between the two walls 32*a*, 32*b*. In the first and second walls 32*a*, 32*b* corresponding elongated openings 33*a*, 33*b* are formed through which the first and second shafts 4, 7 pass or can be accessed. The mentioned openings 33*a*, 33*b* or at least the opening 33*a* of the first wall 32*a* in the operator side are sized to allow the passage of rubber-wrapped blanket roller or sleeve 5*a*, plate cylinder roller or sleeve 5*b*, plate roller or sleeve 8*a* and screen roller or sleeve 8*b* of all sizes from a minimum format to a maximum format.

The linear guide system 2 comprises a first pair of upper and lower guide elements 26*a*, 26*b* fixed to said first wall 32*a* above and below the corresponding opening 33*a* and a second pair of upper and lower guide elements 27*a*, 27*b* fixed to said second wall 32*b* above and below the corresponding opening 33*b*. The mentioned guide elements 26*a*, 26*b*, 27*a*, 27*b* of the linear guide system 2 are arranged in horizontal directions. In the operator side supports 3*a*, 6*a* of the first and second carriages 3, 6 adjacent to the first wall 32*a* there are fixed at least one pair of upper and lower runners 28*a*, 28*b*, 30*a*, 30*b* coupled respectively to the first pair of upper and lower guide elements 26*a*, 26*b*, and in the transmission side supports 3*b*, 6*b* of the first and second carriages 3, 6 adjacent to the second wall 32*b* at the side opposite the operator there are fixed at least one pair of upper and lower runners 29*a*, 29*b*, 31*a*, 31*b* coupled respectively to the second pair of upper and lower guide elements 27*a*, 27*b*. Thus, the first and second carriages are displaced alongt the same guide elements 26*a*, 26*b*, 27*a*, 27*b*.

With this arrangement, the upper guide elements 26*a*, 27*a* of the first and second pairs of guide elements are above the first and second shafts 4, 7 and the lower guide elements 26*b*, 27*b* of the first and second pairs of guide elements are below the first and second shafts 4, 7. The upper and lower guide elements 26*a*, 26*b*, 27*a*, 27*b* are sufficiently separated to not interfere with the rubber-wrapped blanket roller or sleeve 5*a*, plate cylinder roller or sleeve 5*b*, plate roller or sleeve 8*a* and screen roller or sleeve 8*b* when these are installed in or extracted from the corresponding first and second shafts 4, 7 through the first opening 33*a*, regardless of its size. Although it is not essential, in the illustrated example the upper guide elements 26*a*, 27*a* and the lower guide elements 26*b*, 27*b* are equidistant from the first and second shafts 4, 7.

The displacements of the first and second carriages 3, 6 are actuated, in an embodiment, by means of a nut and screw system actuated by electric motors. For example, the operator side support 3*a* of the first carriage 3 has fixed thereon a pair of upper and lower nuts 36*a*, 36*b* (FIG. 7) coupled to a first pair of first upper and lower screws 34*a*, 34*b* assembled on the first wall 32*a* of the support structure 32 (see also FIGS. 1 to 6), and the transmission side support 3*b* of the first carriages 3 has fixed thereon a pair of upper and lower nuts 37*a*, 37*b* (FIG. 7) coupled to a second pair of first upper and lower screws 35*a*, 35*b* assembled on the second wall 32*b* of the support structure 32. All the first screws 34*a*, 34*b*, 35*a*, 35*b* extend along of a first portion of the linear guide system 2 closest to the printing roller 1*a* or central printing drum 1*b*, and are operatively connected to be actuated in unison by a first electric motor 38 (FIGS. 1 a 6) such that the rotation of the first screws 34*a*, 34*b*, 35*a*, 35*b* displaces the first carriage 3 along said first portion of the linear guide system 2. Similarly, the operator side support 6*a* of the second carriage 6 has fixed thereon a pair of upper and lower nuts 41*a*, 41*b* (FIG. 8) coupled to a first pair of second upper and lower screws 39*a*, 39*b* assembled on the first wall 32*a* of the support structure 32 (see also FIGS. 1 to 6), and the transmission side support 6*b* of the second carriage 6 has fixed thereon at least one pair of upper and lower nuts 42*a*, 42*b* (FIG. 8) coupled to a second pair of second upper and lower screws 40*a*, 40*b* (FIG. 8) assembled on the second wall 32*b* of the support structure 32. All the second screws 39*a*, 39*b*, 40*a*, 40*b* extend along a second portion of the linear guide system 2 furthest away from the printing roller 1*a* or central printing drum 1*b*, and are operatively connected to be actuated in unison by a second electric motor 43 (FIGS. 1 a 6) such that the rotation of the second screws 39*a*, 39*b*, 40*a*, 40*b* displaces the second carriage 6 along said second portion of the linear guide system 2. Although it is not essential, in the illustrated example the first screws 34*a*, 34*b*, 35*a*, 35*b* and the second screws 39*a*, 39*b*, 40*a*, 40*b* are aligned to one another in each position and superimposed to the guide elements 26*a* 26*b*, 27*a*, 27*b*.

Alternatively linear motors could be used for displacing the first and second carriages 3, 6. Referring to the linear guide system, this could include guide elements arranged alternatively only in the lower part or only in the upper part of the support structure 32 with reference to the support shafts 4 and 7, with a reinforced T- or L-configuration of the carriages 3, 6 for supporting the corresponding runners coupled to the linear guide elements.

Figure 9:
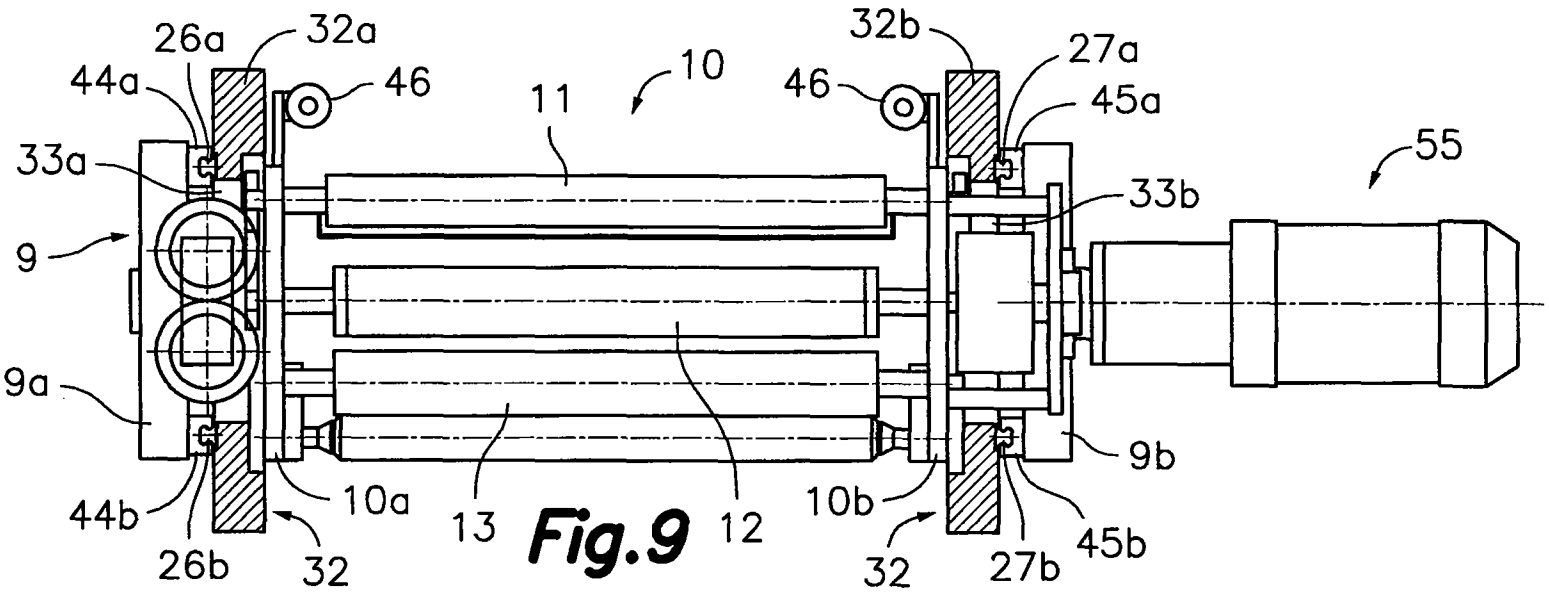
FIG. 9 is a transverse cross-section view of a third carriage of the printing group of FIG. 1 equipped with an offset printing head.
Figure 10:
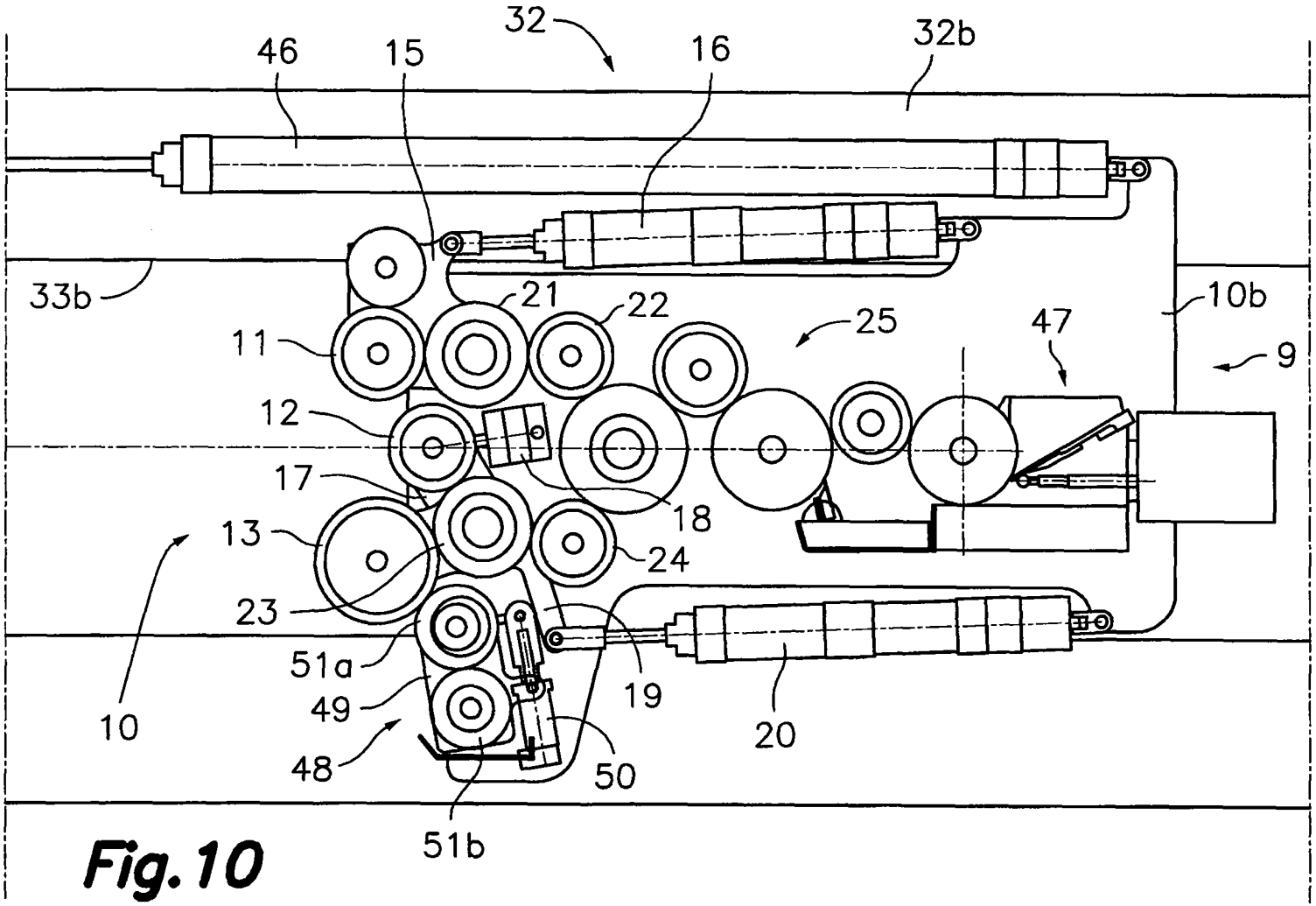
FIG. 10 is a schematic side partial view of the printing group showing the offset printing head in a resting position.

As shown in FIG. 9, the third carriage 9 has an operator side support 9*a* at the side of the support structure 32 wherein the operator is and a transmission side support 9*b* at the opposite side. In the transmission side support 9*b* there are installed actuation and transmission devices 55 for rotating the rollers of the offset inking head 10. In the operator side support 9*a* there are fixed at least one pair of upper and lower runners 44*a*, 44*b* coupled respectively to the first pair of upper and lower guide elements 26*a*, 26*b* installed in the first wall 32*a* of the support structure 32, and in the transmission side support 9*b* there are fixed at least another pair of upper and lower runners 45*a*, 45*b* coupled respectively to the second pair of upper and lower guide elements 27*a*, 27*b* installed in the second wall 32*b* of the support structure 32, such that the third carriage 9 is displaced along the same guide elements 26*a*, 26*b*, 27*a*, 27*b* as the first and second carriages 3, 6. The ink-supplying rollers 11, 12, 13 and other components of the offset inking head 10 are installed between a pair of first and second plates 10*a*, 10*b* located in the lower part of the first and second walls 32*a*, 32*b* of the support structure 32 and connected, respectively, with the operator side support 9*a* and the transmission side support 9*b* of the third carriage 9, respectively, through the openings 33*a*, 33*b* of the support structure 32. Between each of the first and second plates 10*a*, 10*b* of the offset inking head 10 and the respective first and second wall 32*a*, 32*b* of the support structure 32 there is arranged a corresponding linear actuator 46 (see also FIGS. 10 to 13) connected to the same by their ends. The extension and retraction of the linear actuators 46 displace the third carriage 9 with the offset inking head along the guiding system 2.

Alternative arrangements for the linear guide system 2 and for the actuation devices for displacing the first, second and third carriages 3, 6, 9 would be obvious to a person skilled in the art without departing from the scope of the present invention.

Now in relation with FIGS. 10 to 13 the basic characteristics of the offset inking head 10 of the present invention are described. The ink-supplying rollers 11, 12, 13 of the offset inking head 10, which are configured to come into contact with the plate sleeve 8*a* comprise an upper ink-supplying roller 11, a central ink-supplying roller 12 and a lower ink-supplying roller 13. The central ink-supplying roller 12 is assembled in a central pivoting support 17 and a central linear actuator 18 is arranged to push said central pivoting support 17 until pressing said central ink-supplying roller 12 against the plate sleeve 8*a*. The upper ink-supplying roller 11 is assembled in an upper pivoting support 15 and an upper linear actuator 16 is arranged to push said upper pivoting support 15 until pressing said upper ink-supplying roller 11 against the plate sleeve 8*a*. The lower ink-supplying roller 13 is assembled in a lower pivoting support 19 and a lower linear actuator 20 is arranged to push said lower pivoting support 19 until pressing said lower ink-supplying roller 13 against the plate sleeve 8*a*. The upper ink-supplying roller 11 is in contact with an upper ink-transferring roller 21 which is coaxial with a pivoting shaft of the upper pivoting support 15 and in turn is in contact with an upper fixed roller 22 of a train of ink-transferring rollers 25. The central ink-supplying roller 12 and the lower ink-supplying roller 13 are in contact with a lower ink-transferring roller 23 which is coaxial with a common pivoting shaft of the central pivoting support 17 and of the lower pivoting support 19, which in turn is in contact with a lower fixed roller 24 of said train of ink-transferring rollers 25. One or more rollers of the train of ink-transferring rollers 25 are intermittently in contact with an ink-applying group 47.

A water-applying group 48 comprising a pair of water-transferring rollers 51*a*, 51*b* associated to a water application tank is assembled on another pivoting support 49. The pivoting support 49 of the water-applying group 48 is displaced by the movement of the lower pivoting support 19, to which it is mechanically linked. The contact between the two water-transferring rollers 51*a*, 51*b* can be controlled by means of actuating a linear actuator 50 to control or eliminate the flow of water to be delivered. A mechanical element linking the pivoting supports 19 and 49 can be selectively moved by a linear actuator (not shown) to contact the upper water-transferring roller 51*a* with the lower ink-supplying roller 13 for the purpose of performing a wet offset printing, or not to contact, for performing a dry or waterless offset printing.

It must be taken into account that for a wet offset printing, first the water must be applied and then the ink must be applied on the surface of the plate roller 8*a*. FIGS. 1 to 6 and 10 to 13 show a right-hand printing group 65 adapted for an anti clockwise rotation direction of the plate roller 8*a* (indicated by means of an arrow in the drawings), which coincides with the rotation direction of the printing roller or drum 1*a*, 1*b* and with the displacement direction of the substrate in the form of continuous band. Due to this reason, in the illustrated example the water-applying group 48 is associated to the lower ink-supplying roller 13. It will be understood that a left hand printing group adapted for a plate roller 8*a* rotating in the same anti clockwise direction indicated by the arrows would have the water-applying group 48 associated to the upper ink-supplying roller 11. Similarly, it will also be understood that if the plate roller 8*a* rotates in the opposite direction, i.e., a clockwise rotation direction, in a right hand printing group the water-applying group 48 would be associated to the upper ink-supplying roller 11 and in a left hand printing group the water-applying group 48 would be associated to the lower ink-supplying roller 13.

In the illustrated embodiment, all the linear actuators are pneumatic cylinders, although for the purposes of the present invention they could be of other nature such as linear electric actuators, hydraulic cylinder actuators, etc.

Figure 11:
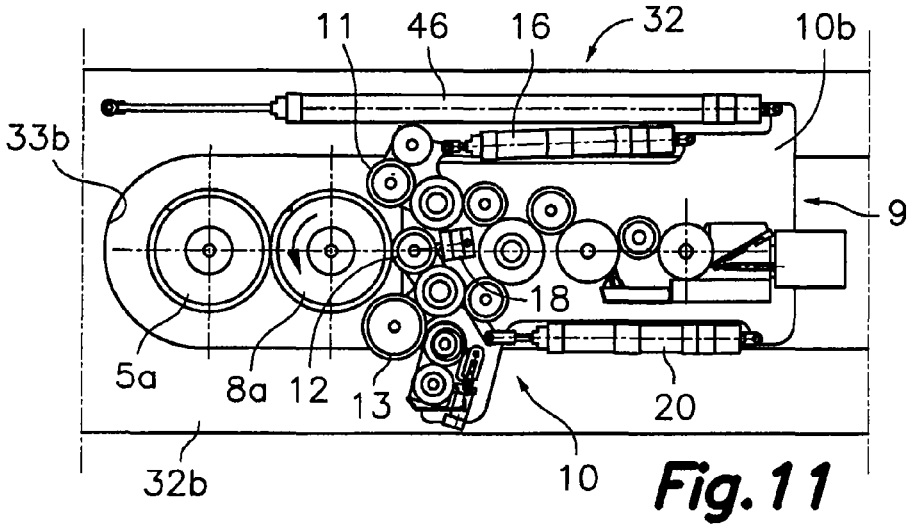
FIG. 11 is a schematic side partial view of the printing group showing the offset printing head in an approximating position on a maximum format.
Figure 12:
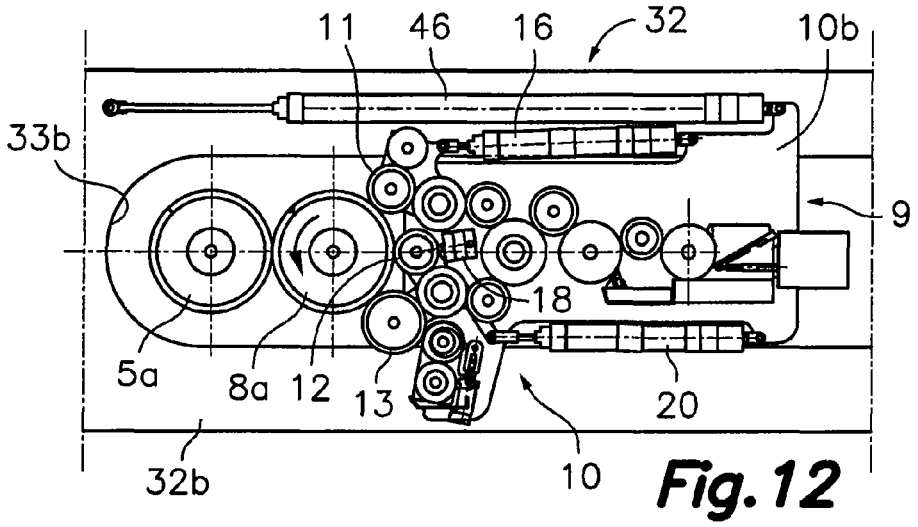
FIG. 12 is a schematic side partial view of the printing group showing the offset printing head in a working position on the maximum format.

The operation of the offset inking head 10 is the following. Assuming that the third carriage 9 is initially in the resting position shown in FIG. 10 (equivalent to the position of the third carriage 9 shown in FIGS. 2 and 4), and that on the first and second shafts 4, 7 corresponding rubber-wrapped blanket roller or sleeve 5*a* and plate roller or sleeve 8*a*, which have been depicted in a maximum format in FIGS. 11 and 12, are installed. Firstly, the first and second carriages 3, 6 are displaced to their corresponding working positions in which the rubber-wrapped blanket sleeve 5*a* is in contact with the printing roller 1*a* or central printing drum 1*b* and the plate sleeve 8*a* is in contact with the rubber-wrapped blanket sleeve 5*a*. Then the upper and lower linear actuators 16, 20 are activated to locate the corresponding upper and lower ink-supplying rollers 11, 13 in respective retracted positions whereas the central linear actuator 18 is activated to locate the central ink-supplying roller 12 in an extended position. Then, the linear displacement actuators 46 are activated to retract and thereby move the third carriage 9 with the offset inking head 10 towards the second carriage 6 until the central ink-supplying roller 12, which is in its extended position, contacts with the plate sleeve 8*a*. In this position, a locking device is actuated to lock the linear displacement actuators 46 and thereby immobilize the third carriage 9 in a reference working position, whereas the offset inking head 10 is in an approximation position in which the central ink-supplying roller 12 is in contact with the plate sleeve 8*a* and the upper and lower ink-supplying rollers 11, 13 are separated from the same (FIG. 11).

Figure 13:
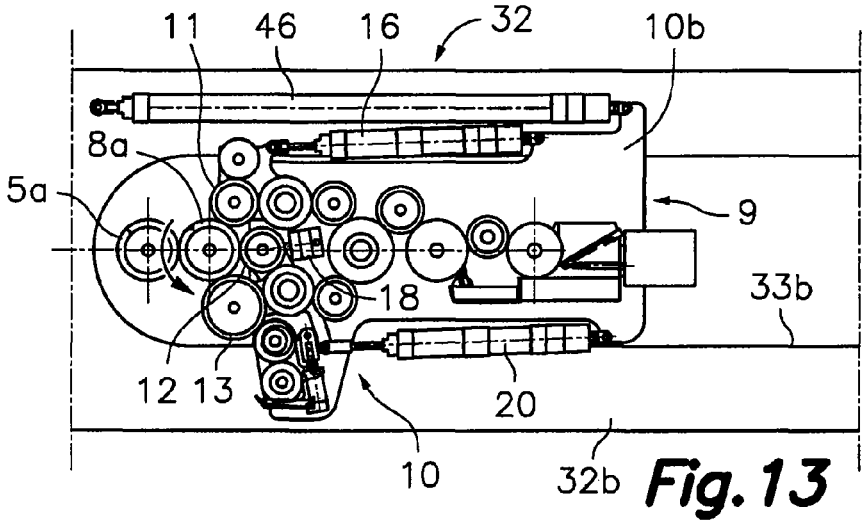
FIG. 13 is a schematic side partial view of the printing group showing the offset printing head in a working position on a minimum format.

Then, while the third carriage 9 is maintained in the reference working position, the upper and lower linear actuators 16, 20 are activated towards their extended positions for pivoting the respective upper and lower pivoting supports 15, 19 until the upper and lower ink-supplying rollers 11, 13 contact with the plate sleeve 8*a*, regardless of the diameter of the same. Thereby, the offset inking head 10 reaches a working position (FIG. 12) in which the three ink-supplying rollers 11, 12, 13 are in contact with the plate sleeve 8*a*. FIG. 12 shows the offset inking head 10 in the working position on the maximum acceptable format (rubber-wrapped blanket roller or sleeve 5*a* and plate roller or sleeve 8*a* of maximum diameter) and FIG. 13 shows the same offset inking head 10 in the working position on the minimum acceptable format (rubber-wrapped blanket roller or sleeve 5*a* and plate roller or sleeve 8*a* of minimum diameter). It is observed that the reference working positions of the third carriage 9 and the working positions of the offset inking head are different in FIGS. 12 and 13, because such positions depend on the format and are automatically reached in virtue of the special construction of the printing group of the present invention. The offset inking head 10 has devices configured to lock the upper and lower linear actuators 16, 20 for actuating the movements of the upper and lower pivoting supports 15, 19 in the working position adapted to the format with which it is working, and this in combination with the maintenance of the central linear actuator 18 in the extended position keeps the upper, central and lower ink-supplying rollers 11, 12, 13 in the working position.

From the reference working position of the third carriage 9 it is possible to automatically generate an out-of-contact position (not shown) of the offset inking head 10 in which, without a displacement of the third carriage 9, the upper, central and lower ink-supplying rollers 11, 12, 13 are out-of-contact with the plate sleeve 8*a* by a small pivoting of the upper, central and lower pivoting supports 15, 17, 19 towards a retracted position. In an embodiment, the upper and lower linear actuators 16, 20 are double stroke pneumatic cylinders and the out-of-contact position is achieved by activating the central linear actuator 18 and the sections corresponding to a second stroke of the upper and lower linear actuators 16, 20 towards a retracted position.

FIGS. 14 to 19 show exemplary embodiments of a printing machine of the present invention including printing groups 65 such as that described above in relation with FIGS. 1 to 13, wherein the printing groups 65 are in the form of modules combined according to several possible configurations. The horizontal arrangement of the guide elements 26*a*, 26*b*, 27*a*, 27*b* in the printing groups 65 facilitates piling together the same when they are in the form of modules provided with an individual support structure 32. Nevertheless, it must be noted that the printing machine of the present invention is not limited to be formed by modules, but it can include several printing groups according to the principles of the present invention incorporated in a common support structure instead of each module having its particular support structure 32.

Figure 14:
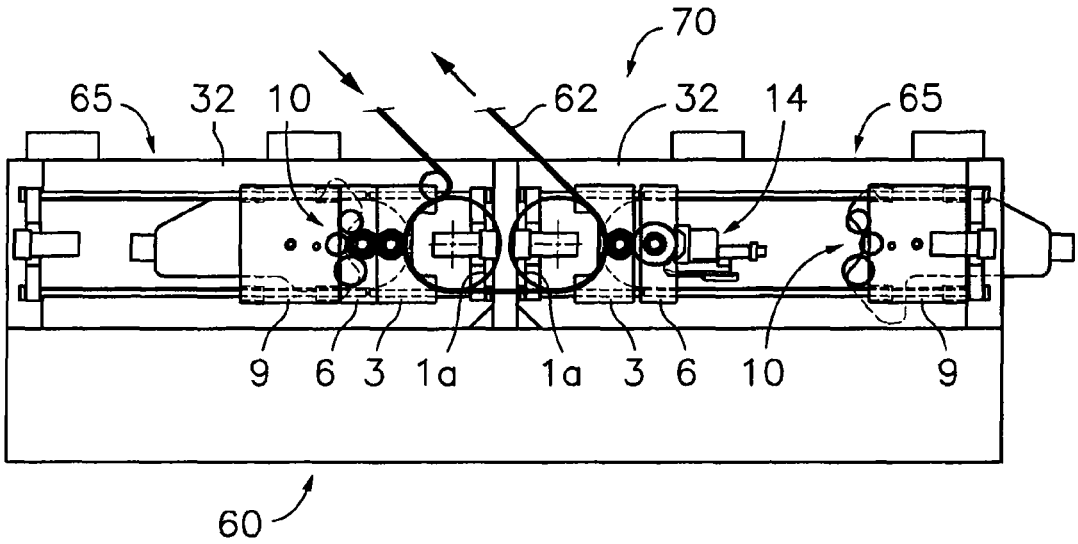
FIG. 14 is a schematic side view of a printing machine for variable format offset with fixed position printing roller or drum according to an embodiment of the present invention, including a pair of printing groups such as that of FIGS. 1-6, each group with a corresponding printing roller.

FIG. 14 shows a printing machine 70 formed by two of the printing groups 65 of the present invention, wherein each printing group 65 has an individual support structure 32 and is arranged in relation with the fixed position of an individual printing roller 1*a*, which can be installed in the same support structure 32. The two support structures 32 of the printing groups 65 are connected with one another and/or with other structural elements to form a structural assembly 60 for the printing machine 70. The two printing rollers 1*a* are arranged mutually adjacent one next to the other for dynamically and successively supporting a substrate in the form of continuous band 62 on which the printing is performed. In an alternative configuration (not shown), the two printing groups 65 could be piled together and with the respective printing rollers 1*a* adjacent one on top of the other, or a pile of more than two superimposed printing groups 65 could be formed.

Figure 15:
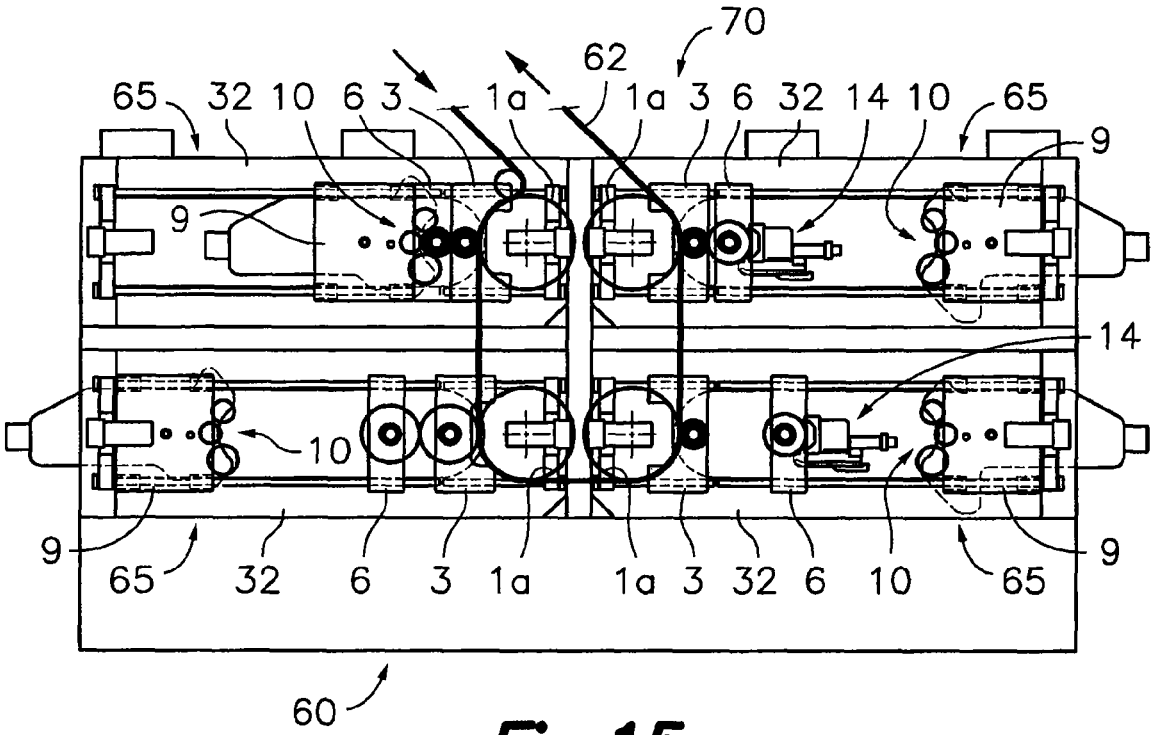
FIG. 15 is a schematic side view of a printing machine according to another embodiment including two pairs of printing groups such as that of FIGS. 1-6, each group with a corresponding printing roller.

FIG. 15 shows a variant of the printing machine 70 of FIG. 14 in which two pairs of printing groups 65 are piled together, each printing group 65 including an individual printing roller 1*a* and an individual support structure 32. The two printing rollers 1*a* of each pair are arranged in fixed positions mutually adjacent one next to the other, and the printing rollers 1*a* of both pairs are adjacent one on top of the other. The substrate in the form of continuous band 62 is dynamically and successively supported by all the printing rollers 1*a*. The four support structures 32 of the printing groups 65 are connected with one another and/or with other structural elements to form a structural assembly 60 for the printing machine 70. It will be understood that a printing machine 70 with more than two pairs of printing groups 65 piled together with a printing roller 1*a* for each printing group 65 could be formed in a similar manner.

Figure 16:
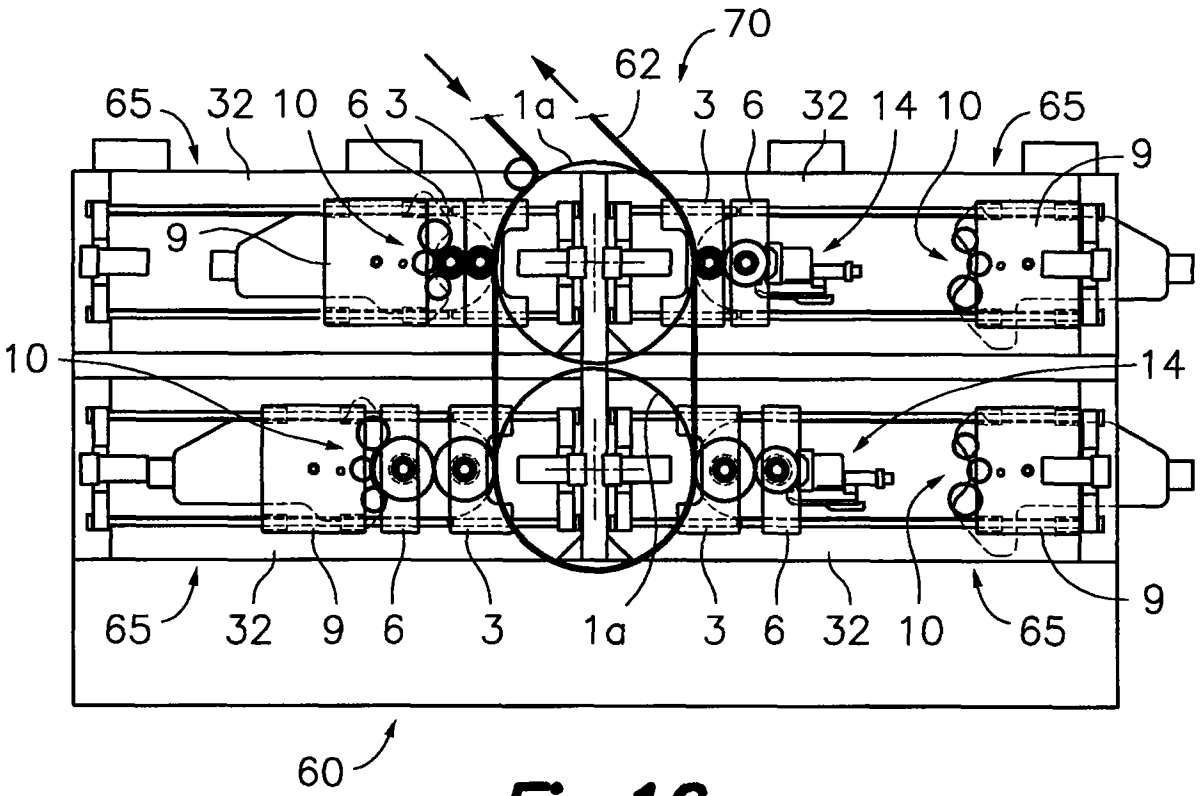
FIG. 16 is a schematic side view of a printing machine according to another embodiment including two pairs of printing groups such as that of FIGS. 1-6, each pair with a corresponding common printing roller.

The printing machine 70 shown in FIG. 16 comprises, in a manner similar to that shown in FIG. 15, two pairs of printing groups 65 piled together, although herein the printing groups 65 of each pair are located in opposite sides of a common printing roller 1*a*, and the two printing rollers 1*a* are arranged adjacent one on top of another for dynamically and successively supporting the substrate in the form of continuous band 62 on which the printing is performed. The four particular support structures 32 of the printing groups 65 are connected with one another and/or with other structural elements to form a structural assembly 60 for the printing machine 70 and the two printing rollers 1*a* are preferably installed in fixed positions in elements of said structural assembly 60. It is understood that alternatively, and in a manner similar to that shown in FIG. 16, a printing machine 70 with a column of more than two pairs of printing groups 65 piled together with a printing roller 1*a* for each pair could be formed, or the printing machine 70 could have only one pair of printing groups 65 in opposite sides of a common single printing roller 1*a*.

Figure 17:
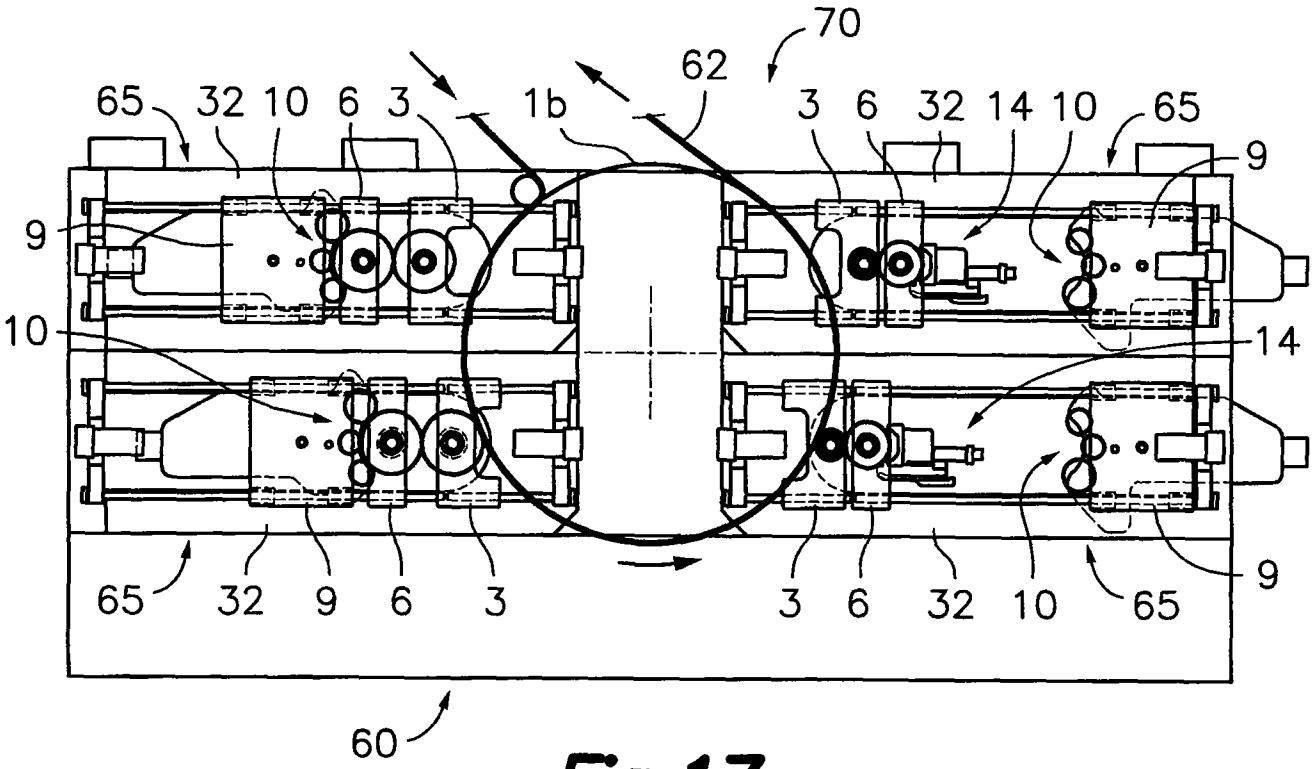
FIG. 17 is a schematic side view of a printing machine according to another embodiment including two pairs of printing groups such as that of FIGS. 1-6 with a single common central printing drum.

FIG. 17 shows a printing machine 70 provided with a central printing drum 1*b* dynamically supporting the substrate in the form of continuous band 62 on which the printing is performed, and four printing groups 65, two of them arranged at one side of the central printing drum 1*b* and the other two at the opposite side. In this case, although it is not essential, the four printing groups 65 are arranged in symmetrical positions both with respect to a horizontal plane and to a vertical plane passing through the axis of the central printing drum 1*b*. The particular support structures 32 of the four printing groups 65 are connected with one another and/or with other structural elements to form a structural assembly 60 for the printing machine 70, and the central printing drum 1*b* is installed on the structural assembly 60 in a fixed position.

Figure 18:
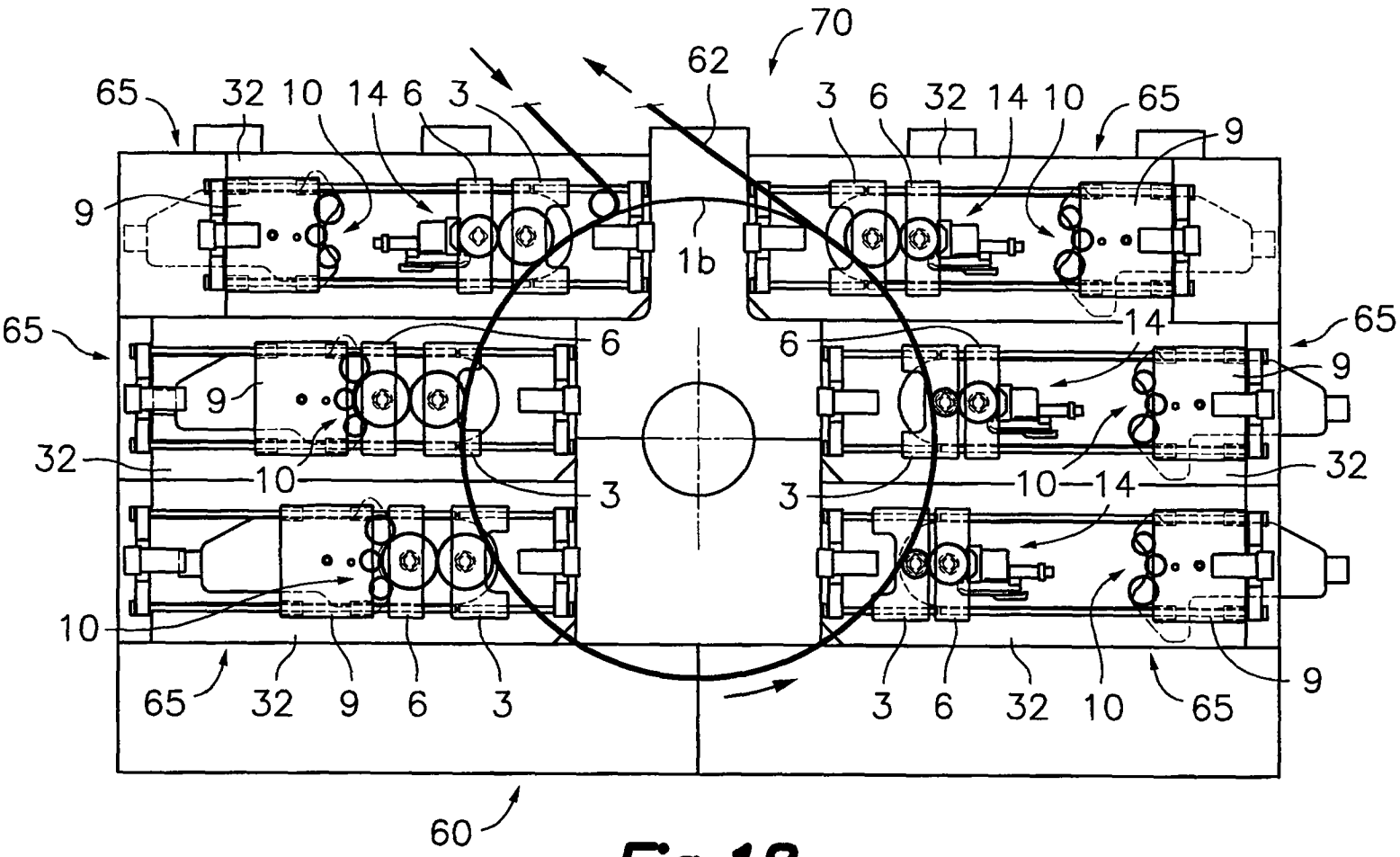
FIG. 18 is a schematic side view of a printing machine according to another embodiment including three pairs of printing groups such as that of FIGS. 1-6 with a single common central printing drum.

FIG. 18 shows a printing machine 70 provided with a central printing drum 1*b* dynamically supporting the substrate in the form of continuous band 62 on which the printing is performed, and six printing groups 65, three of them arranged at one side of the central printing drum 1*b* and the other three at the opposite side. In this case the three printing groups 65 piled together at each side of the central printing drum 1*b* not all are vertically aligned. The particular support structures 32 of the six printing groups 65 are connected with one another and/or with other structural elements to form a structural assembly 60 for the printing machine 70, and the central printing drum 1*b* is installed on the structural assembly 60 in a fixed position.

Figure 19:
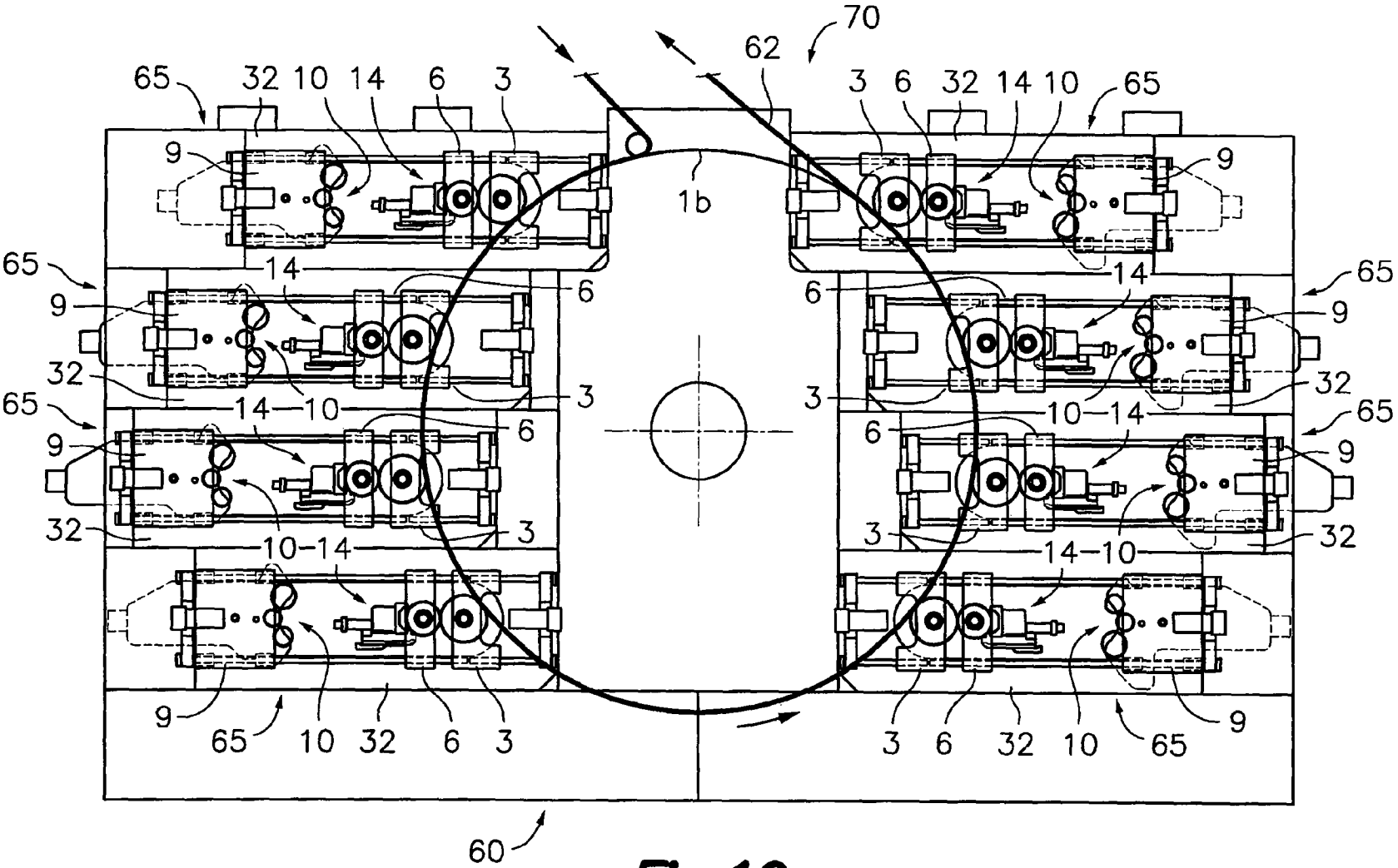
FIG. 19 is a schematic side view of a printing machine according to another embodiment including four pairs of printing groups such as that of FIGS. 1-6 with a single common central printing drum.

FIG. 19 shows a printing machine 70 provided with a central printing drum 1*b* dynamically supporting the substrate in the form of continuous band 62 on which the printing is performed, and eight printing groups 65, four of them arranged at one side of the central printing drum 1*b* and the other four at the opposite side. In this case the four printing groups 65 piled together at each side of the central printing drum 1*b* are not all vertically aligned. The particular support structures 32 of the eight printing groups 65 are connected with one another and/or with other structural elements to form a structural assembly 60 for the printing machine 70, and the central printing drum 1*b* is installed on the structural assembly 60 in a fixed position.

It is understood that, in view of the different configurations of printing machine 70 with central printing drum 1*b* shown in FIGS. 17, 18 and 19, alternative configurations will be obvious for a person skilled in the art without departing from the scope of the present invention. For example, a printing machine 70 provided with a central printing drum 1*b* and more than eight printing groups 65, or with a number of printing groups at the right hand different from the number of printing groups at the left hand of the central printing drum 1*b*, etc.

What is significantly important about the printing machine 70 formed from printing groups 65 in the form of modules or with the printing groups incorporated in a common support structure of the present invention, is that it allows successively printing by means of a plurality of printing groups in offset system with readily variable format on a substrate in the form of relatively elastic continuous band, such as plastic without considerable losses or misregister because the substrate in the form of continuous band can be dynamically supported on a single central printing drum having a fixed position throughout the printing process. This eliminates the defects produced by vibration of the substrate and tension variations of the substrate which are typically produced in the regions between printing rollers of adjacent printing groups in the offset printing machines of the prior art when a relatively elastic thin substrate in the form of non-supported continuous band is printed.

Nevertheless, as has been exemplified by means of FIGS. 14, 15 and 16, the printing machine 70 of the present invention is not limited to the use of a central printing drum 1*b* and can use other combinations of printing rollers 1*a* which, in all cases, provide very short non-supported regions for the substrate in the form of continuous band 62 from a printing group to another in comparison with the prior art machines.

Furthermore, the particular construction of the printing groups 65 of the present invention allows converting the offset printing group easily and quickly into a flexographic printing group, such that a printing machine of the present invention provided with multiple printing groups is capable of printing everything in offset, everything in flexographic, or parts in offset and parts in flexographic. Likewise, the particular construction of the printing groups 65 of the present invention allows performing a format change easily and quickly both in offset and in flexography.

A person skilled in the art will be able to introduce modifications and variations to the embodiments shown and described without departing from the scope of the present invention as defined in the attached claims.

The invention claimed is:

1. A printing machine for variable format offset which incorporates in combination at least one printing roller or central printing drum in a fixed position, and at least one printing group, said printing group comprising:

a fixed linear guide system fixed in a support structure in relation with said printing roller or central printing drum;

a first carriage arranged to be displaced by first actuating means along said linear guide system and provided with support devices configured for supporting in a rotatable and exchangeable manner an offset rubber-wrapped blanket roller or sleeve selected from a set of offset rubber-wrapped blanket rollers or sleeves of different sizes;

a second carriage arranged to be displaced by second actuating means along said linear guide system and provided with support devices configured for supporting in a rotatable and exchangeable manner an offset plate roller or sleeve selected from a set of offset plate rollers or sleeves of different sizes; and a third carriage arranged to be displaced by third actuating means along said linear guide system and on which is installed an offset inking head provided with devices for approximating said third carriage to said offset plate roller or sleeve installed in said second carriage, and identifying and fixing a reference working position of the third carriage in relation with the offset plate roller or sleeve.

2. The printing machine according to claim 1, wherein said offset inking head comprises a plurality of ink-supplying rollers including a central ink-supplying roller assembled in a central movable support and a central linear actuator arranged to move said central movable support and said central ink-supplying roller between an extended position, in which the central ink-supplying roller determines said reference working position for the third carriage when, with the rest of the ink-supplying rollers being in a retracted position, the central ink-supplying roller contacts with the offset plate roller or sleeve in a working position, and a retracted position, in which the central ink-supplying roller together with the rest of the ink-supplying rollers are out-of-contact with the offset plate roller or sleeve whereas the third carriage is maintained in said reference working position, and means for fitting said rest of the ink-supplying rollers to the perimeter of the offset plate roller or sleeve.

3. The printing machine according to claim 2, wherein:

said support devices of the first carriage are configured for supporting in a rotatable and exchangeable manner a flexographic plate cylinder roller or sleeve selected from a set of flexographic plate cylinder rollers or sleeves of different sizes substituting said offset rubber-wrapped blanket roller or sleeve;

said support devices of the second carriage are configured for supporting in a rotatable and exchangeable manner a flexographic screen roller or sleeve substituting said offset plate roller or sleeve; and said offset inking head is provided with devices to separate the third carriage from the second carriage a sufficient distance to allow installing a flexographic inking unit operatively associated to a flexographic screen roller or sleeve installed in the second carriage.

4. The printing machine according to claim 3, wherein the central ink-supplying roller has a rotation axis located, in said working position, in the same geometric plane as a first shaft about which the offset rubber-wrapped blanket roller or sleeve rotates and a second shaft about which the offset plate roller or sleeve rotates.

5. The printing machine according to claim 3, wherein said flexographic inking unit is fixed to said second carriage and moves with the same.

6. The printing machine according to claim 1, wherein the linear guide system is arranged to guide the movements of the first, second and third carriages in a horizontal direction.

7. The printing machine according to claim 6, wherein said support structure comprises first and second facing walls, and the linear guide system comprises a first pair of upper and lower guide elements fixed to said first wall and to which there are coupled at least one corresponding pair of upper and lower runners fixed in a first end of each of the first, second and third carriages, and a second pair of upper and lower guide elements fixed to said second wall and to which there are coupled at least one corresponding pair of upper and lower runners fixed in a second end of each of the first, second and third carriages.

8. The printing machine according to claim 7, wherein the upper guide elements of the first and second pairs of guide elements are above the offset rubber-wrapped blanket roller or sleeve and offset plate roller or sleeve, respectively, and the lower guide elements of the first and second pairs of guide elements are below the offset rubber-wrapped blanket roller or sleeve and offset plate roller or sleeve, and are sufficiently separated to allow the passage of offset rubber-wrapped blanket roller or sleeve, flexographic plate cylinder roller or sleeve, offset plate roller or sleeve and flexographic screen roller or sleeve of all sizes from a minimum format to a maximum format between the upper and lower guide elements, and through an opening formed in at least one wall of first and second walls of the support structure.

9. The printing machine according to claim 1, further comprising at least two of said printing groups and a printing roller for each printing group, said printing rollers being arranged for successively supporting a substrate in the form of continuous band on which the printing is performed.

10. The printing machine according to claim 1, further comprising at least one pair of said printing groups located in opposite sides of a common printing roller arranged for supporting a substrate in the form of continuous band on which the printing is performed.

11. The printing machine according to claim 10, further comprising at least two of said pairs of printing groups, each pair with a common printing roller, the printing rollers being arranged for successively supporting a substrate in the form of continuous band on which the printing is performed.

12. The printing machine according to claim 1, wherein it comprises a number of said printing groups located in opposite sides of a single central printing drum arranged for supporting a substrate in the form of continuous band on which the printing is performed.

13. A printing group for variable format offset comprising in combination:

a fixed linear guide system fixed in a support structure in relation with a printing roller or central printing drum installed in a fixed position in said support structure or in a structural assembly which the support structure forms part thereof;

a first carriage arranged to be displaced by first actuating means along said linear guide system and provided with support devices configured for supporting in a rotatable and exchangeable manner an offset rubber-wrapped blanket roller or sleeve selected from a set of offset rubber-wrapped blanket rollers or sleeves of different sizes;

a second carriage arranged to be displaced by second actuating means along said linear guide system and provided with support devices configured for supporting in a rotatable and exchangeable manner an offset plate roller or sleeve selected from a set of offset plate rollers or sleeves of different sizes; and a third carriage arranged to be displaced by third actuating means along said linear guide system and on which is installed an offset inking head provided with devices for approximating said third carriage to said offset plate roller or sleeve installed in said second carriage, and identifying and fixing a reference working position of the third carriage in relation with the offset plate roller or sleeve.

14. The printing group according to claim 13, wherein said offset inking head comprises a plurality of ink-supplying rollers including a central ink-supplying roller and upper and lower ink-supplying rollers, said central ink-supplying roller is assembled in a central movable support and a central linear actuator is arranged to move said central movable support and said central ink-supplying roller between an extended position, in which the central ink-supplying roller determines said reference working position for the third carriage when, with said upper and lower ink-supplying rollers in the retracted position, the central ink-supplying roller contacts with the offset plate roller or sleeve in a working position, and a retracted position, in which the central ink-supplying roller together with the rest of the ink-supplying rollers are out-of-contact with the offset plate roller or sleeve whereas the third carriage is maintained in said reference working position, and means for fitting said ink-supplying rollers to the perimeter of the offset plate roller or sleeve.

15. The printing group according to claim 14, wherein:

said support devices of the first carriage are configured for supporting in a rotatable and exchangeable manner a flexographic plate cylinder roller or sleeve selected from a set of flexographic plate cylinder rollers or sleeves of different sizes substituting said offset rubber-wrapped blanket roller or sleeve;

said support devices of the second carriage are configured for supporting in a rotatable and exchangeable manner a flexographic screen roller or sleeve substituting said offset plate roller or sleeve; and said offset inking head is provided with devices to separate the third carriage from the second carriage a sufficient distance to allow installing a flexographic inking unit operatively associated to a flexographic screen roller or sleeve installed in the second carriage.

16. The printing group according to claim 15, wherein the central ink-supplying roller has a rotation axis located in said working position, in the same geometric plane as a first shaft about which the offset rubber-wrapped blanket roller or sleeve rotates and a second shaft about which the offset plate roller or sleeve rotates.

17. The printing group according to claim 15, wherein said flexographic inking unit is fixed to said second carriage and moves with the same.

18. The printing group according to claim 17, wherein said support structure comprises first and second facing walls and the linear guide system comprises a first pair of upper and lower guide elements fixed to said first wall and to which there are coupled at least one corresponding pair of upper and lower runners fixed in a first end of each of the first, second and third carriages, and a second pair of upper and lower guide elements fixed to said second wall and to which there are coupled at least one corresponding pair of upper and lower runners fixed in a second end of each of the first, second and third carriages.

19. The printing group according to claim 18, wherein the upper guide elements of the first and second pairs of guide elements are above the offset rubber-wrapped blanket roller or sleeve and offset plate roller or sleeve, respectively, and the lower guide elements of the first and second pairs of guide elements are below the offset rubber-wrapped blanket roller or sleeve and offset plate roller or sleeve, and are sufficiently separated to allow the passage of offset rubber-wrapped blanket roller or sleeve, flexographic plate cylinder roller or sleeve, offset plate roller or sleeve and flexographic screen roller or sleeve of all sizes from a minimum format to a maximum format between the upper and lower upper guide elements and through an opening formed in at least one wall of first and second walls of the support structure.

20. The printing group according to claim 13, wherein the linear guide system is arranged to guide the movements of the first, second and third carriages in a horizontal direction.

21. The printing group according to claim 20, wherein the support structure is configured to be coupled to the support structure of at least one similar printing group and/or to other structural elements to form a structural assembly of a printing machine including a plurality of similar printing groups and at least one printing roller or a central printing drum arranged for supporting a substrate in the form of continuous band on which the printing is performed.

* * * * *